US007762064B2

(12) United States Patent
Tennison

(10) Patent No.: US 7,762,064 B2
(45) Date of Patent: Jul. 27, 2010

(54) EXHAUST SYSTEM FOR AN ENGINE

(75) Inventor: Paul Tennison, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 944 days.

(21) Appl. No.: 11/551,613

(22) Filed: Oct. 20, 2006

(65) Prior Publication Data

US 2008/0092533 A1 Apr. 24, 2008

(51) Int. Cl.
*F01N 3/02* (2006.01)

(52) U.S. Cl. ..... 60/317; 60/274; 60/289; 60/298; 60/319; 60/320; 60/324

(58) Field of Classification Search ..... 60/289, 60/316, 319, 274, 298, 304, 307, 315, 317, 60/318, 320, 324; D12/194
See application file for complete search history.

(56) References Cited

U.S. PATENT DOCUMENTS 1,382,690 A * 6/1921 Stokes ..... 181/262
1,401,368 A * 12/1921 Schneebeli ..... 181/232
1,813,189 A * 7/1931 Moore ..... 181/262
2,233,327 A * 2/1941 Sauer ..... 181/262
2,389,059 A * 11/1945 Kurth ..... 181/259
2,548,563 A * 4/1951 Smith ..... 181/262
2,586,788 A * 2/1952 Cushman ..... 181/262
2,629,455 A * 2/1953 Cushman ..... 181/262
2,829,731 A * 4/1958 Clayton ..... 423/212
3,186,511 A * 6/1965 Kliewer, Sr. ..... 181/259
3,771,315 A * 11/1973 Scott ..... 60/297
3,981,449 A 9/1976 Krey et al.
4,926,683 A * 5/1990 Ishizeki ..... 73/115.08
5,570,576 A * 11/1996 Ament et al. ..... 60/300

(Continued)

OTHER PUBLICATIONS

Juan, Tim et al., "Compact Post-Aftertreatment Temperature Control Device for Exhaust Gas Cooling," SAE International Technical Papers, 2007-01-4199, Oct. 2007.

(Continued)

*Primary Examiner*—Binh Q. Tran
(74) *Attorney, Agent, or Firm*—Allan J. Lippa; Alleman Hall McCoy Russell & Tuttle LLP

(57) ABSTRACT

An exhaust system for an engine, comprising of a first exhaust passage providing a first flow area, a second exhaust passage communicatively coupled to the first exhaust passage, the second exhaust passage providing a second flow area greater than the first flow area, wherein the second exhaust passage is arranged downstream of the first exhaust passage, wherein a first wall surface of the first exhaust passage defines at least a first opening for transferring air external the first exhaust passage to within the first exhaust passage and a second wall surface of the second exhaust passage defines at least a second opening for transferring air external the second exhaust passage to within the second exhaust passage, a first protrusion disposed within the first exhaust passage upstream of the first opening, and a second protrusion disposed within the second exhaust passage upstream of the second opening.

21 Claims, 14 Drawing Sheets

U.S. PATENT DOCUMENTS

| | | | | |
|---|---|---|---|---|
| 6,748,736 | B1 | 6/2004 | Claverie et al. | |
| 6,915,629 | B2 * | 7/2005 | Szymkowicz | 60/289 |
| 6,973,959 | B1 | 12/2005 | Claverie et al. | |
| 2005/0205355 | A1 | 9/2005 | Lin | |
| 2005/0284623 | A1 | 12/2005 | Poole et al. | |
| 2007/0119985 | A1 | 5/2007 | Ranganathan et al. | |
| 2008/0087006 | A1 | 4/2008 | Wu et al. | |

OTHER PUBLICATIONS

Baus, Mattew et al., "Integrating New Emissions Engines into Commercial Vehicles: Emissions, Performance & Affordability," 51st Annual L. Ray Buckendale Lecture, Commercial Vehicle Engineer Conference and Exhibition: Rosemont, Illinois, Nov. 1, 2006.

"Exhaust Gas Diluters," Nett Technologies Inc., 2-6707, Mississauga, Ontario, pp. 1-5.

* cited by examiner

EXHAUST SYSTEM FOR AN ENGINE

BACKGROUND AND SUMMARY

Some engines may include an exhaust system having one or more aftertreatment devices. As one example, a diesel engine may have an exhaust system that includes a diesel particulate filter (DPF) for removing particulate matter from the exhaust passage prior to exhausting the gases produced by the engine to the surrounding environment. During some operations, a DPF may burn off built-up filtered particulate matter, thereby regenerating the filter. Regeneration may occur passively under conditions where sufficient exhaust heat is generated by the operation conditions. Alternatively, or in addition, exhaust gas temperature can be increased via engine measures and/or exhaust heating provided by heating elements to burn off the particulate matter stored within the DPF.

However, the inventors herein have recognized that during some conditions regeneration may cause the gases exiting the exhaust system and/or various components of the exhaust system to attain a substantially higher temperature. For example, temperatures exiting the exhaust system may be as high as 550° C., even during low engine output conditions, such as during idle. Further, some exhaust system components including a DPF and/or other aftertreatment devices may have a relatively high thermal inertia, thereby causing the exhaust gases and/or exhaust system to maintain an elevated temperature even after a regeneration operation has been completed.

One approach that attempts to reduce exhaust gas temperature is described in U.S. Pat. No. 6,973,959, where a heat exchanger device arranged in the exhaust passage may be used to extract heat from the exhaust gases flowing therein. In another approach, as set forth in U.S. Publication No. 2005/0205355, a converging nozzle/venturi device is used to cool the exhaust gases by adding ambient air into the exhaust system prior to being exhausted.

However, the inventors herein have also recognized that in the above executions, both of these approaches can generate more back pressure to the exhaust system upstream of the device than desired. The increased backpressure may result in reduced engine performance and/or efficiency.

In one approach, the above issues may be addressed by an exhaust system for an engine, comprising a first exhaust passage providing a first flow area; a second exhaust passage communicatively coupled to the first exhaust passage, the second exhaust passage providing a second flow area greater than the first flow area, wherein the second exhaust passage is arranged downstream of the first exhaust passage; wherein a first wall surface of the first exhaust passage defines at least a first opening for transferring air external the first exhaust passage to within the first exhaust passage and a second wall surface of the second exhaust passage defines at least a second opening for transferring air external the second exhaust passage to within the second exhaust passage; a first protrusion disposed within the first exhaust passage upstream of the first opening; and a second protrusion disposed within the second exhaust passage upstream of the second opening.

In this way, it may be possible to reduce the temperature of the gases exiting the exhaust system and/or reduce the temperature of various exhaust system components, such as those arranged downstream of the openings. The radial configuration of the air entrainment devices can result in a smaller increase in backpressure or backpressure penalty than may exist with similar devices arranged in series. The use of the radial arrangement can reduce the backpressure penalty for a given amount of entrained air due to the combined decrease in flow area achieved by the parallel grouping of entrainment devices. Further, by using entrained air both upstream and downstream of an expansion of the flow, the inventors herein have found that sufficient cooling of exhaust gases may be provided with a reduced backpressure penalty due to the synergistic effects of the pressure gain associated with the expansion and the improved efficiency of the entrainment device configuration.

While this approach may provide improved exhaust cooling with reduced backpressure, additional cooling approaches may be used, if desired. For example, heat exchangers and converging/diverging nozzles may still be used, if desired.

DETAILED DESCRIPTION

Figure 1A:
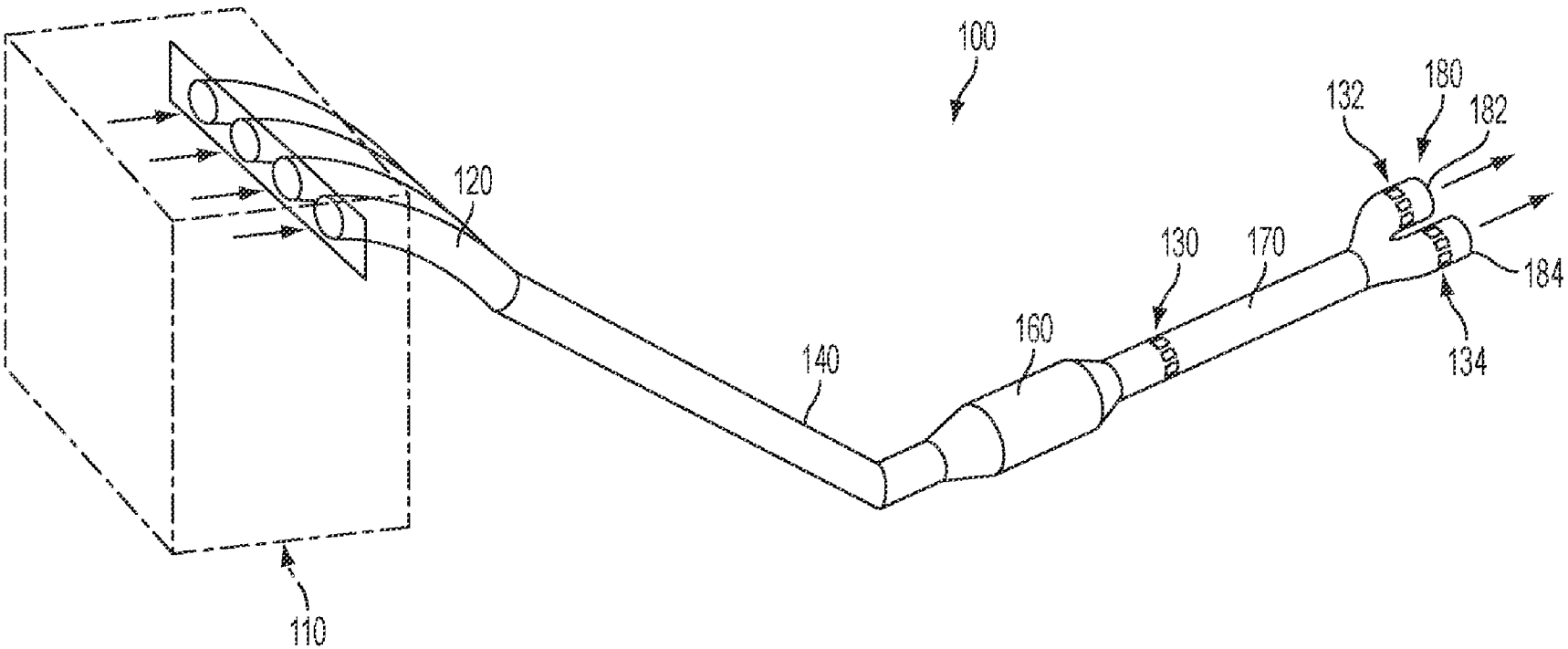
FIGS. 1A and 1B show example exhaust systems coupled to an engine.
Figure 1B:
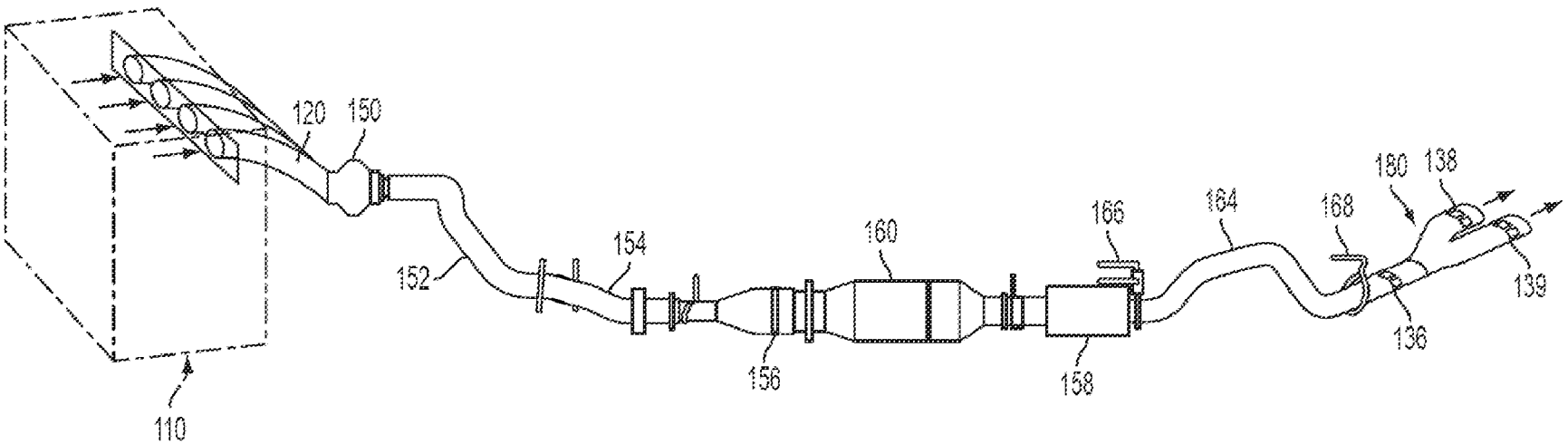

Vehicles having an internal combustion engine may utilize an exhaust system for treating the combustion products produced by the engine prior to exhausting them to the surrounding environment. FIG. 1A shows an example exhaust system 100 coupled to an engine 110. Engine 110 represents an engine having four cylinders in an in-line configuration; however, it should be appreciated that engine 110 can have different numbers of cylinders or cylinder configurations including in-line or v-engines having six, eight, ten or twelve cylinders, for example. In addition, while FIG. 1A shows a single path exhaust system, a dual exhaust path system may be used, such as with a v-type engine, where two of the illustrated exhaust system may be used. Alternatively, one exhaust system connected with a single inlet through the use of a center mounted turbocharger may be used, as shown in FIG. 1B, for example. Further, engine 110 can be configured to combust diesel, gasoline, alcohol, etc., among other fuels and combinations thereof. In one example, engine 110 may be a diesel engine that may be used with a vehicle such as a truck or more specifically a pick-up truck; however the various approaches described herein may be used with an exhaust system for any vehicle.

Various components of exhaust system 100 are shown coupled to engine 110 by an exhaust manifold 120. Exhaust manifold 120 is shown having four ports for receiving exhaust gases from each of the four engine cylinders, with the four ports of the exhaust manifold converging downstream of the engine into a single pipe or passage. Exhaust manifold 120 may be coupled to a diesel particulate filter (DPF) 160 (in the case of a diesel engine) via a down pipe 140. DPF 160 can be configured to remove at least a portion of the diesel particulate matter (including soot) from the exhaust gases produced by engine 110. In one example, DPF 160 may be a porous wall catalyst including materials such as silicon carbide, ceramic, and/or sintered metal for filtering particulate matter in the exhaust gases. Further, the filtered exhaust gases may then flow downstream of the DPF via tail pipe 170 before reaching an exiting pipe 180, wherein the exhaust gases are finally exhausted to the surrounding environment.

Figure 5A:
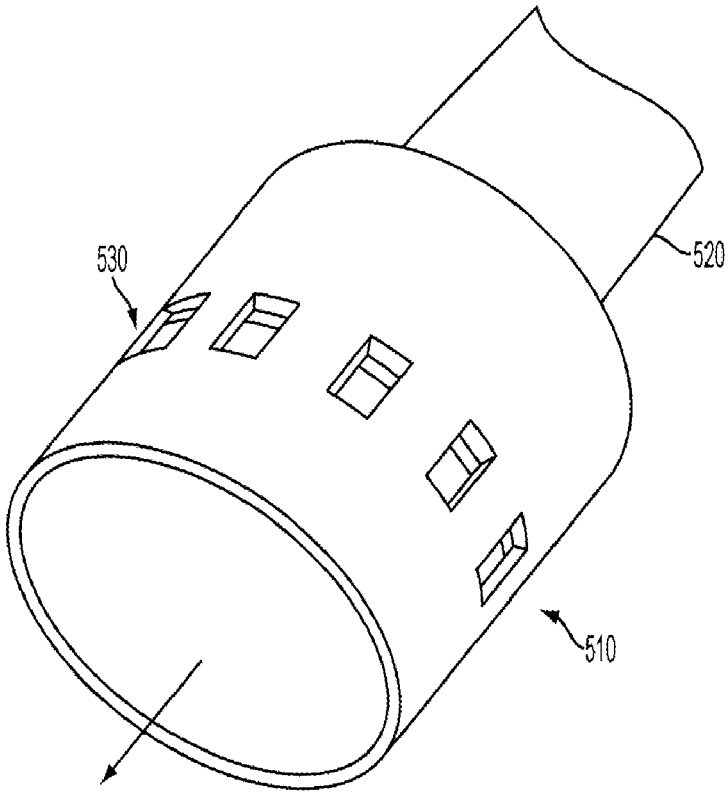
FIGS. 5A and 5B show other example exiting pipes.
Figure 5B:
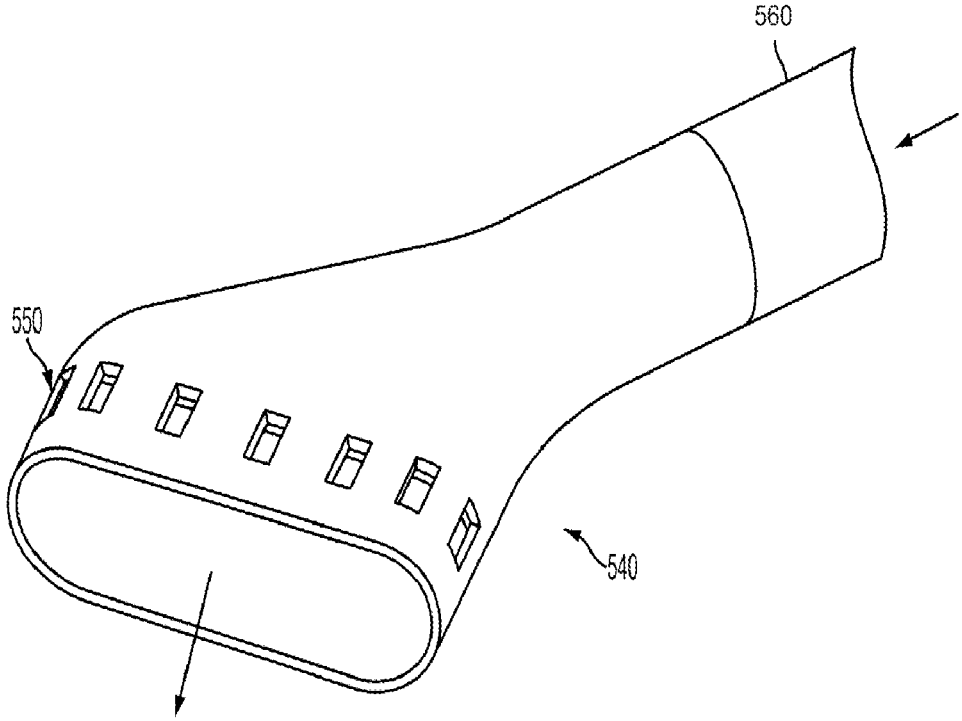

Exiting pipe 180 may have a larger effective cross-sectional area or flow area than at least a portion of the upstream exhaust passages. For example, as shown in FIG. 1A, exiting pipe 180 may include a Y-pipe having a first branch 182 and a second branch 184. In this manner, the effective flow area of exiting pipe 180 (i.e. the combined flow area of branches 182 and 184) may be larger than the flow area of at least a portion of the upstream exhaust passage (e.g. pipe 170). The increased flow area of an exiting pipe can provide some pressure recovery for the exhaust system. While exiting pipe 180 is shown in FIG. 1A having a Y-pipe configuration, other exiting pipes may be used to provide an increased effective flow area to the exhaust gas prior to exiting the exhaust system may be used, for example, as shown in FIGS. 5A and 5B. Further, in some embodiments, an exiting pipe providing an equal or lesser effective flow area may be alternatively used.

Further, in some embodiments, exhaust system 100 may further include one or more other components. For example, exhaust system 100 may include one or more sensors, exhaust passages, branches, NOx traps, mufflers, catalysts, other after treatment devices and/or exhaust system components. For example, the exhaust system may include one or more pressure sensors for detecting the pressure of the exhaust gases at various regions of the exhaust system and/or one or more temperature sensor may be used to detect the temperature of the exhaust gases within the exhaust passage or the temperature of various components such as DPF 160.

FIG. 1B shows another example of an exhaust system for an engine. In this example, the exhaust system is coupled to engine 110 as described above via exhaust manifold 120. In this example, a turbocharger turbine 150 is arranged in the exhaust passage down stream of the exhaust manifold for providing shaft work to a compressor arranged in an intake passage of the engine. A down pipe 152 may be included to transport exhaust gases from the turbine outlet to an inlet pipe 154 to a diesel oxidation catalyst (DOC) 156. Further, the exhaust system of FIG. 1B may include a DPF 160 as described above, arranged down stream of the DOC, for example.

The exhaust system may also include a resonator 158 arranged downstream of the DPF for reducing or varying the noise produced by the exhaust system as exhaust gases flow through the various exhaust system components. In some embodiments, the resonator may be tuned or configured to vary or reduce the noise caused by the addition of one or more air entrainment devices among other exhaust system components. For example, the resonator may be configured to create sound waves that substantially cancel those produced by air being entrained into the exhaust passage in addition to or as an alternative to a muffler.

Further, a tailpipe 164 may be included to convey exhaust gases from the resonator to an exiting pipe 180. Hangers shown generally at 166 and 168 may be used to secure the exhaust system to a vehicle, such on the underside of the vehicle, for example.

Figure 3A:
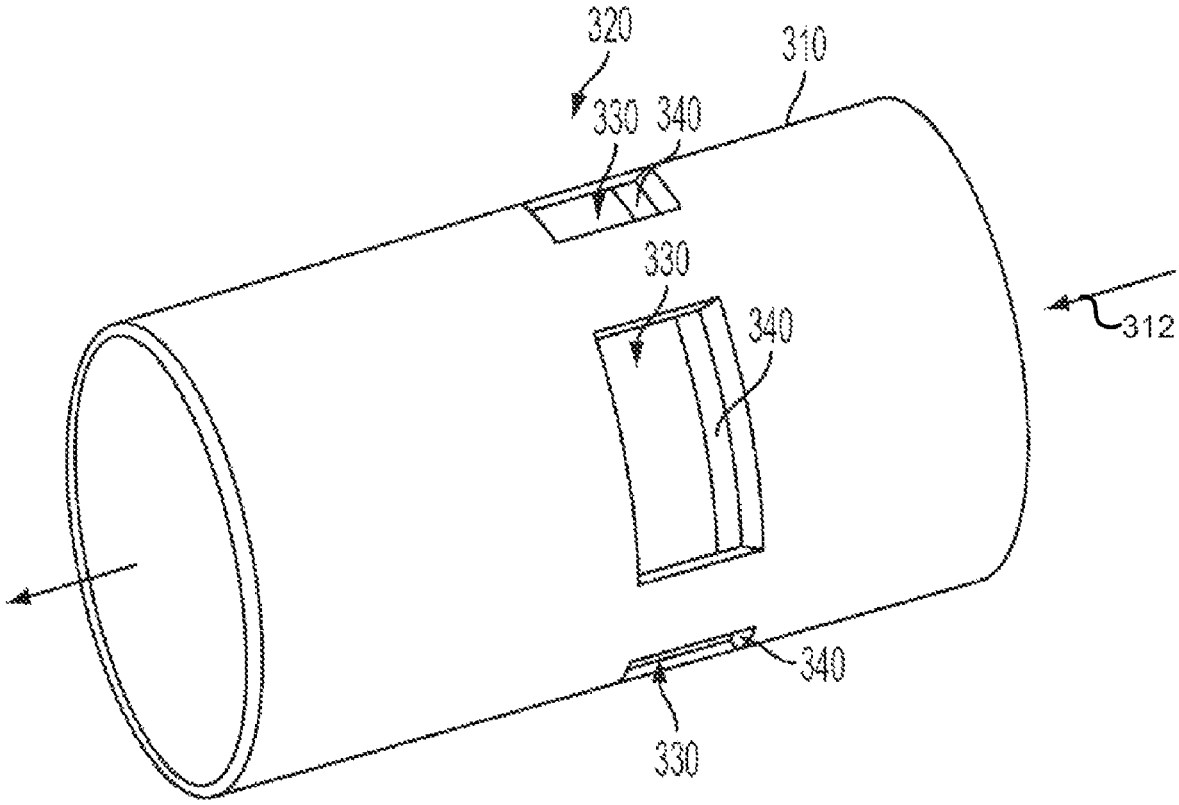
FIGS. 3A and 3B respectively show an exhaust passage having an air entrainment device including a p plurality of radially arranged openings and corresponding tabs.
Figure 3B:
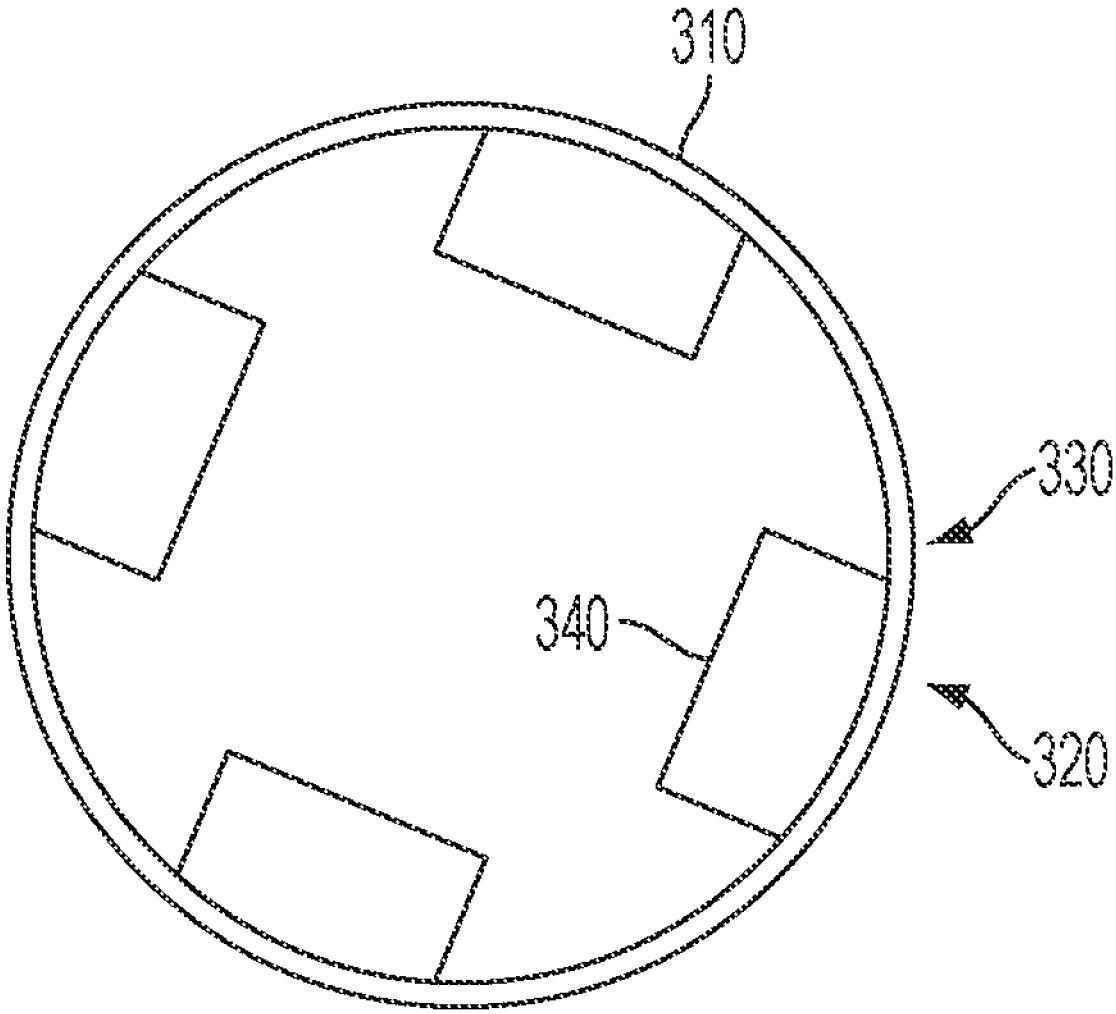
Figure 4A:
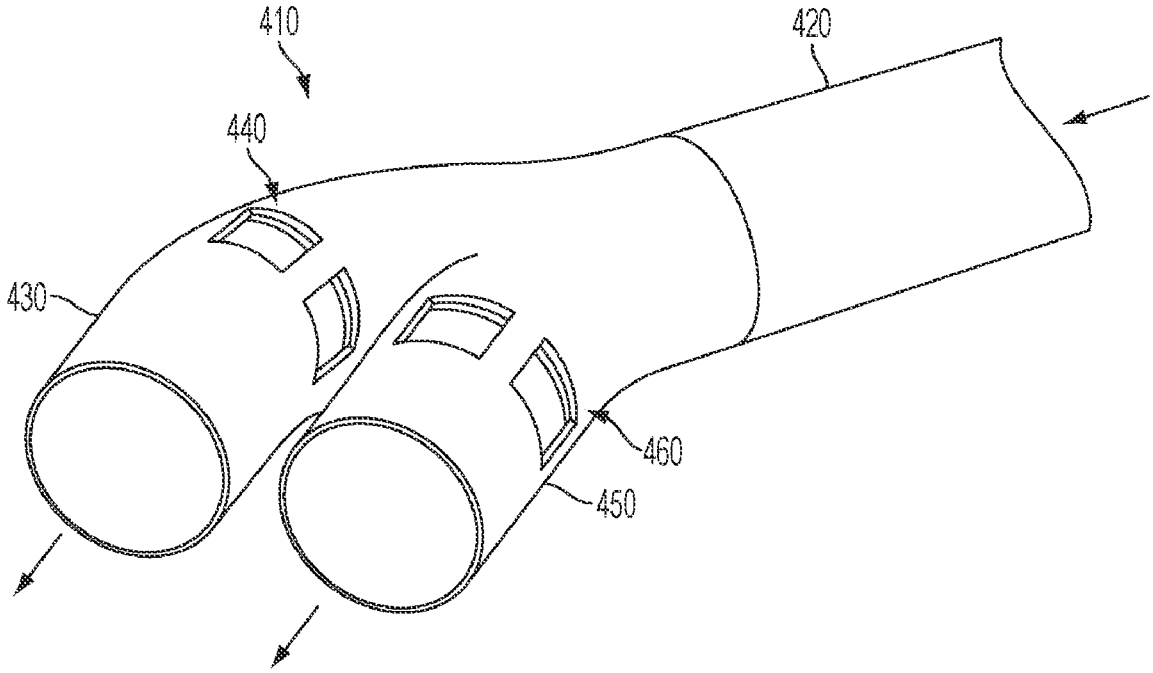
FIGS. 4A and 4B show an example exiting pipe having a Y-pipe configuration.
Figure 4B:
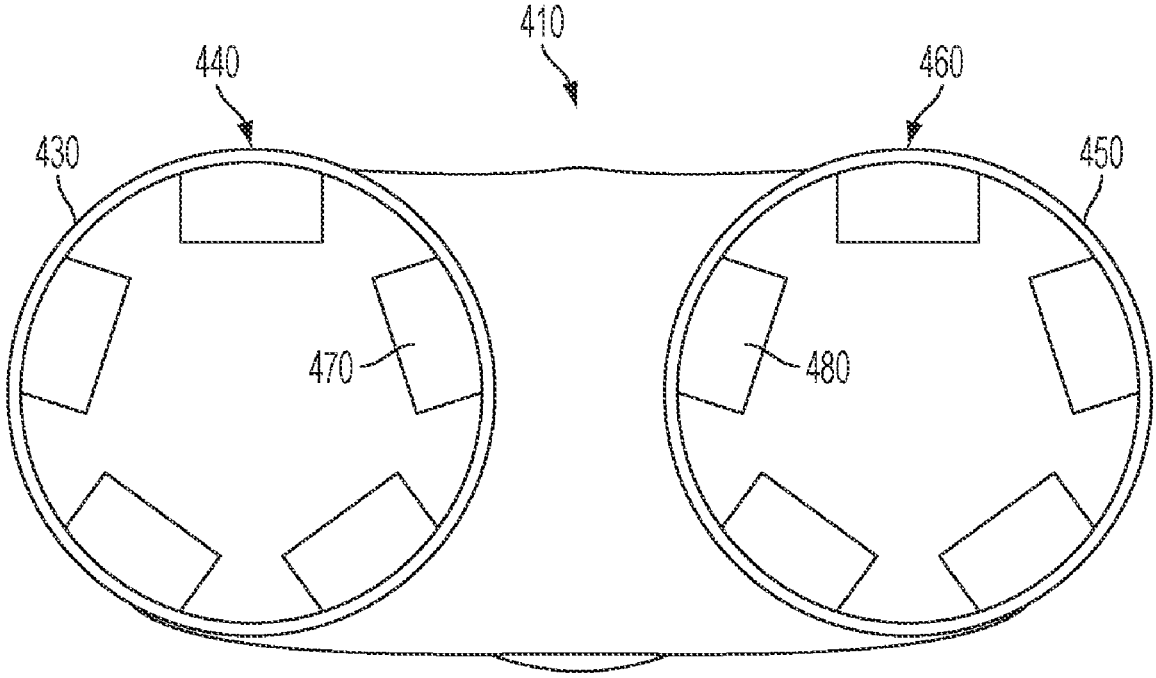

One or more air entrainment devices shown at 136, 138, and 139 may be included to provide cooling of the exhaust gases. As will be described in greater detail below, these air entrainment device may include one or more openings for entraining ambient air into the exhaust passage. Further, as shown in FIGS. 3 and 4, these devices may include one or more tabs within the exhaust passage to increase the amount of air entrained into the exhaust passage. For example, the air entrainment device shown at 136 may include the device described in FIGS. 3A and 3B, while the air entrainment devices shown at 138 and 139 may include the device described in FIGS. 4A and 4B.

During operation of an engine, particulate matter may build up within a diesel particulate filter. In some cases, this build-up of particulate matter may cause increased backpressure on the upstream exhaust system and/or engine, thereby reducing engine efficiency. In one approach, particulate matter may be periodically removed from the filter using a regeneration process. The frequency regenerating the filter may depend on the usage cycle of the engine. For example, a vehicle such as a pick-up truck having a diesel engine that is driven under an average usage cycle may utilize regeneration of the DPF approximately every few hundred miles (e.g. every 300 to 400 miles). However, it should be appreciated that this is merely one example regeneration frequency and that other regeneration strategies may depend on the specific engine and exhaust system configuration and/or the operating conditions or usage cycle of the vehicle.

Further, in some approaches, the frequency of regeneration may be determined by measuring the backpressure caused by the DPF. For example, as the amount of particulate matter stored within the DPF increases, the backpressure caused by the DPF on the exhaust gases upstream of the DPF may increase. Thus, in some embodiments, exhaust system 100 may include a pressure sensor located upstream of DFP 160, for detecting the exhaust gas pressure. In this manner, when backpressure caused by the DFP is increased to a threshold, regeneration may be performed.

Regeneration may include the use of a combustive regeneration operation where heat is added to the exhaust system. In one approach, referred to as passive combustive regeneration, heated exhaust gasses produced by the engine (and some potential NOx oxidation) may be used to add heat to the exhaust system. In another approach, referred to as active combustive regeneration, engine operation may be adjusted to increase exhaust heat and/or additional heat may be added directly to the exhaust gas and/or DPF in addition to the engine out exhaust heat. For example, the exhaust passage located upstream of the DPF and/or the DPF may include one or more electric heating coils. By increasing the amount of heat supplied to DPF, the particulate matter stored within the DPF may be burned off at selected conditions.

In some conditions, such as during active regeneration of the DPF, the exhaust system and exhaust gases exiting the exhaust system may attain a substantially high temperature. For example, temperatures exiting the exhaust system may be on the order of 500° C. or higher, even during low engine output conditions such as during idle. Further, some exhaust system components including the DPF and/or other catalysts or traps may have a relatively high thermal inertia, thereby causing the exhaust gases and/or exhaust system to maintain an elevated temperature even after a regeneration operation has been completed. In some conditions, it may be desirable to reduce the temperature of the exhaust gases exiting the exhaust system or it may be desirable to reduce the temperature of various exhaust system components located downstream of the DPF.

One approach to reduce exhaust gas temperature includes the application of one or more air entrainment devices that admit air into the exhaust passage, thereby reducing the temperature of the exhaust gases and the exhaust system, while also reducing or minimizing the additional backpressure. Further, these air entrainment devices as described herein may be integrated, or integrally formed, within an exhaust system, thereby reducing the total cost of the exhaust system. While the approaches described herein may provide at least some advantages over other approaches for reducing exhaust gas temperature, it should be appreciated that the various configurations described herein may be used in conjunction with these other approaches.

In some embodiments, as shown in FIG. 1A, an exhaust system may include one or more air entrainment devices shown generally at 130, 132 and 134. Each of these air entrainment regions may include at least one opening in the wall of the exhaust passage and a corresponding tab or protrusion located therein. As will be described in greater detail with reference to FIG. 2, these entrainment devices can be used to entrain cooler ambient air into the exhaust system from the surrounding environment.

In some embodiments, a synergistic effect may be achieved by utilizing a plurality of air entrainment regions at different locations of the exhaust system. For example, one or more openings may be arranged at a first location, shown generally at 130, to provide a first entrainment of air, wherein the exhaust gases are allowed to expand to a larger effective flow area at the exiting pipe before a second group of one or more openings may be used to entrain additional air into the exhaust system, for example, via entrainment regions 132 and 134. Further, additional air entrainment may also be used, if desired. In this manner, the temperature of the exhaust passage downstream of the entrainment devices and the gases exiting the exhaust system may be reduced, while reducing the additional backpressure caused by the inclusion of one or more of air entrainment devices. In other words, by using entrainment of air both upstream and downstream of a flow expansion, it is possible to provide the desired exhaust temperature reduction while reducing or minimizing the additional backpressure.

FIG. 2 shows various example air entrainment devices or regions as may be used at various locations of an exhaust system, for example, at 130, 132, and/or 134 of exhaust system 100 as shown in FIG. 1A or 1B, or at still other suitable locations. FIGS. 2A-2F show a side view (axial cross section) of an exhaust passage 200 configured with an air entrainment device 210. Exhaust passage 200 may be a portion of an exhaust system such as pipes 140, 170, 182, and/or 184 of exhaust system 100 described herein, or others. Entrainment device 210 may include at least one opening 212 in the wall of the exhaust passage for entraining air from outside of the exhaust passage and at least one corresponding tab 214 protruding into the flow area upstream of the opening. In some embodiments, a tab may be coupled to the wall of the exhaust passage by a weld or by a fastener or as will be described with reference to FIGS. 2D, 2F, and 2G, or the tab may be punched inward from the wall material to form an opening and corresponding tab. Further, other protrusion structures may also be used, such as bumps, vanes, etc.

Figure 2A:
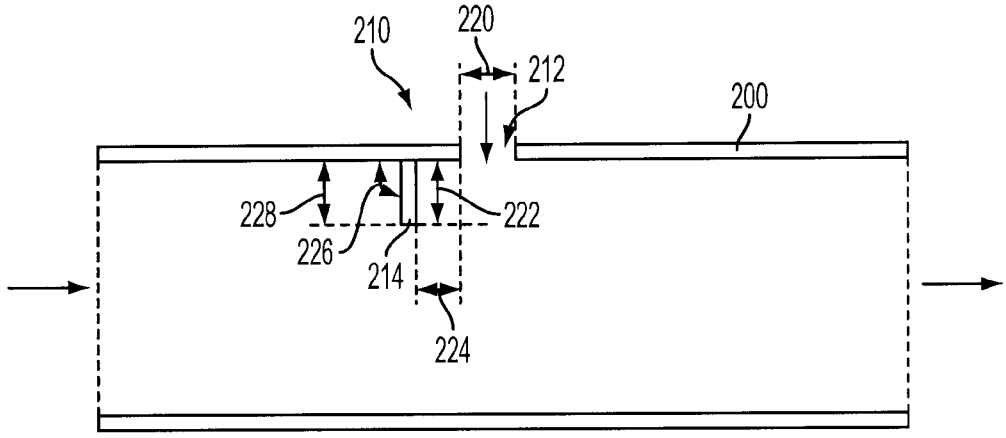
FIGS. 2A-2L show example air entrainment devices including at least one opening and corresponding tab.
Figure 2B:
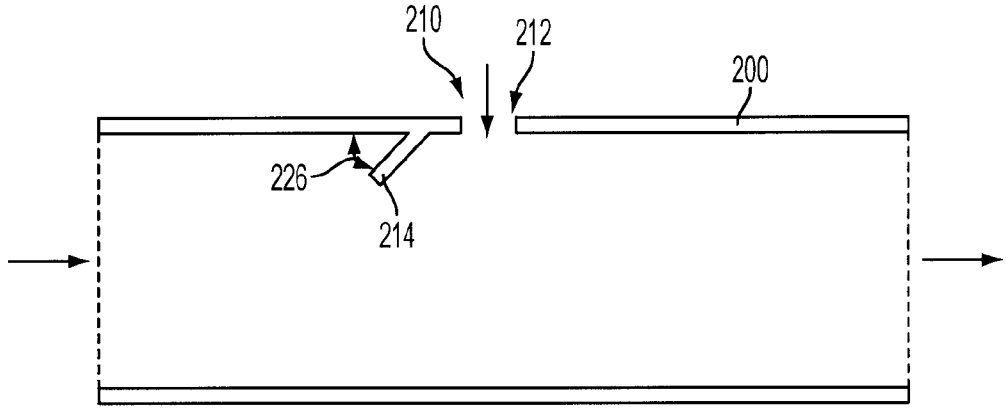
Figure 2C:
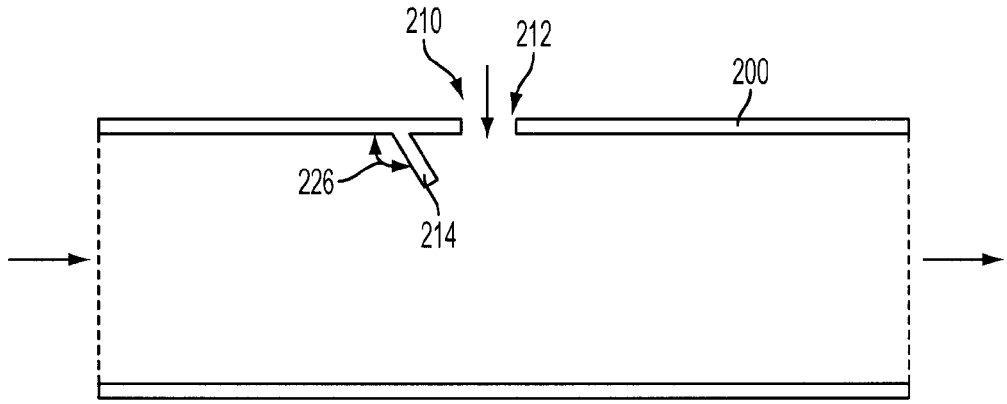

By varying the arrangement of the opening and corresponding tab, the desired air entrainment, the desired exhaust temperature reduction, and/or the desired backpressure applied to the upstream exhaust system may be achieved. For example, the length of the opening along the axis of the passage as indicated by dimension 220, the distance of the tab upstream of the opening as indicated by dimension 224, the angle of the tab as indicated by dimension 226, the length of the tab as indicated by dimension 222, and the depth of protrusion of the tab into the exhaust passage as indicated by dimension 228 may be varied to achieve the air entrainment, exhaust temperature reduction and/or backpressure. As shown in FIG. 2A, tab 214 may be substantially perpendicular to the wall of the exhaust passage (i.e. dimension 226 may be approximately 90 degrees), however other suitable angles may be used as shown in FIGS. 2B and 2C. While tab 214 may be angled into the flow of gases as illustrated in FIG. 2B, it should be appreciated that not all angles may provide a suitable entrainment of air. For example, some configurations where the tab is angled into the flow may cause the exhaust gases in the vicinity of the tab to stall and flow out of the opening.

In this manner, at least one tab may be used to reduce the effective flow area of exhaust passage 200 upstream of the opening. Exhaust gases having a higher temperature than the ambient air of the surrounding environment as shown flowing from the left side of exhaust passage 200 may respond to the decreased flow area in the vicinity of tab 214 by increasing speed, thereby causing a local low pressure region downstream of tab 214, for example, in the vicinity of opening 212. The low pressure region in turn can cause cooler ambient air to be entrained through opening 212, where it mixes with the exhaust gases flowing within the exhaust passage, thereby reducing the overall temperature of the exhaust gases flowing downstream of the entrainment device and/or reducing the temperature of the exhaust system components. However, in some conditions, the temperature reduction of the exhaust system components may be greater for the components located downstream of the entrainment devices.

As described above, the relative size and/or arrangement of opening 212 and/or tab 214 may be varied to achieve the desired temperature reduction, air entrainment and/or back pressure. For example, the depth that tab 214 projects into the flow area of the exhaust passage as indicated by dimension 228 may be of substantially any size between zero (e.g. no tab) and substantially the entire diameter of the exhaust passage. Similarly, the angle of inclination of the tab as indicated by dimension 226 may be varied anywhere between 0 degrees to 180 degrees, for example. Further, the distance of the tab upstream of the opening as indicated by dimension 224 may also be varied to affect the amount of air entrained, etc. In some approaches, the distance of the tab upstream of the opening may be at least partially dependent upon the size (e.g. hydraulic diameter) of the exhaust passage and/or opening, as well as the other dimensions described herein.

FIGS. 2B and 2C show how a tab may be angled relative to the wall of the exhaust passage. For example, FIG. 2B shows tab 214 inclined with the direction of exhaust gas flow, while FIG. 2C shows tab 214 inclined against the direction of exhaust gas flow. By varying the angle of inclination of the tab relative to the wall, the amount of backpressure created and/or air entrained may be varied, and hence the amount of exhaust temperature reduction may be adjusted as desired. For example, the tab configuration shown in FIG. 2B may provide less backpressure to the exhaust system for the amount of air entrained as compared to the configuration of FIG. 2A, at least under some conditions.

Figure 2D:
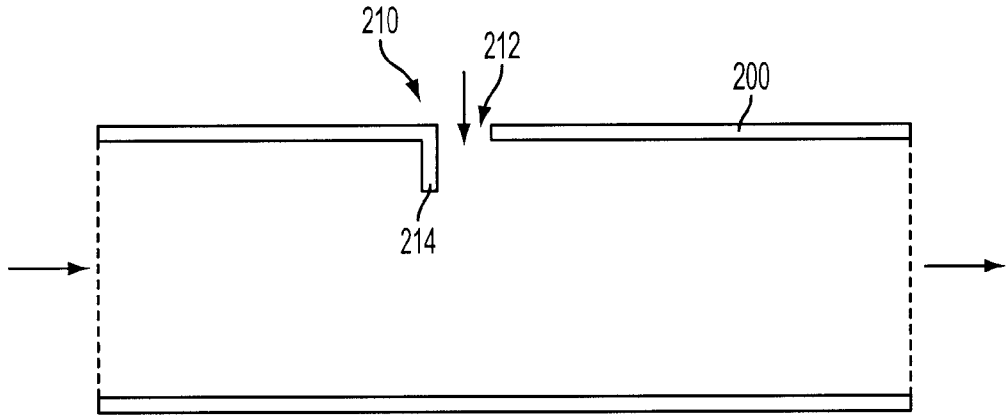
Figure 2E:
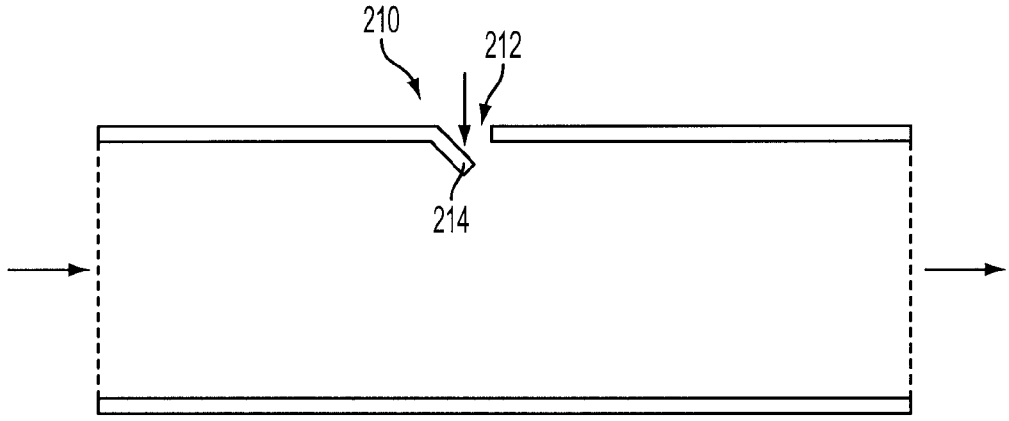
Figure 2F:
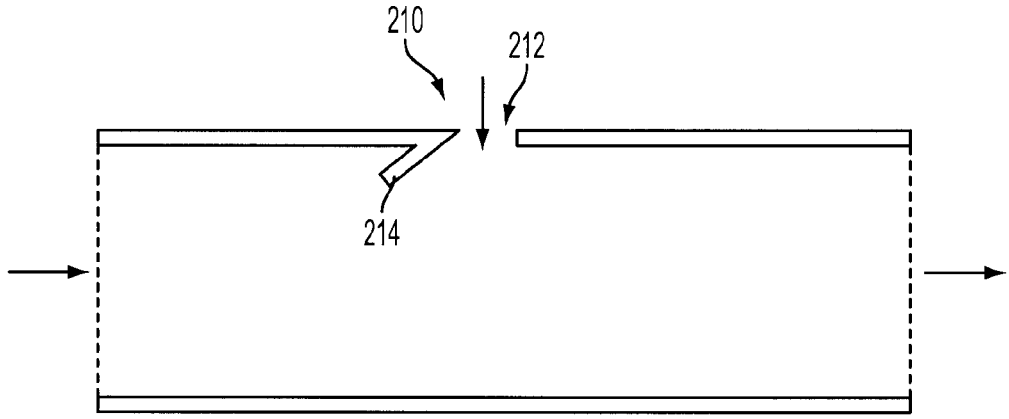

In some embodiments, the material comprising the wall of exhaust passage may be punched inward to form an opening and a corresponding tab. FIGS. 2D, 2E, and 2F show exhaust passage 200 with entrainment device 210 having an opening 212 and tab 214 formed by punching the wall of the exhaust passage inward to a desired angle. For tabs that are punched inward from the wall material of the exhaust passage, the opening may have approximately the same length (e.g. dimension 220) as the length of tab 214 (e.g. dimension 222). However, by varying the angle of the tab relative to the wall of the exhaust passage, the depth of the tab (e.g. dimension 228)

and hence the reduction in effective flow area may be varied independent of the size of the opening. Similarly, for openings that are punched, the width and/or shape of the opening may be substantially similar to the width and/or shape of the tab.

FIGS. 2G-2L show a cross-section of exhaust passage 200 through a plane orthogonal to an axis of the exhaust passage. FIGS. 2G-2L show various example air entrainment devices 210 having a single opening 212 and at least one corresponding tab 214. While only a single tab is shown, it should be appreciated that a plurality of tabs may be used as noted herein.

Figure 2G:
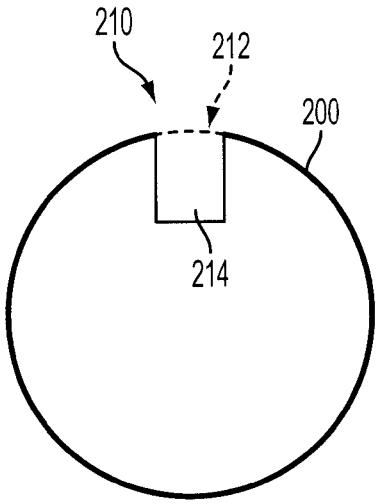
Figure 2H:
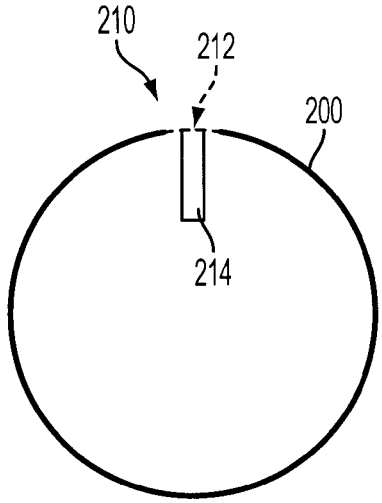
Figure 2I:
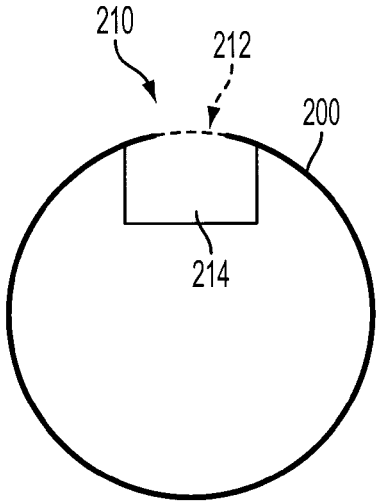
Figure 2J:
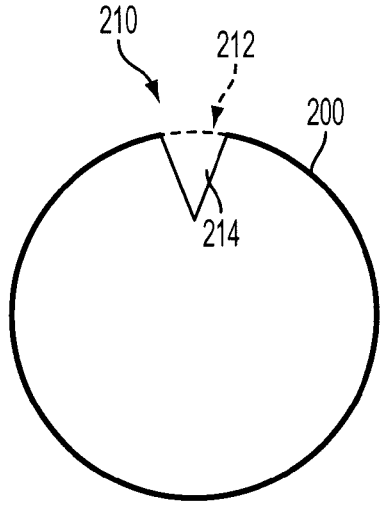
Figure 2K:
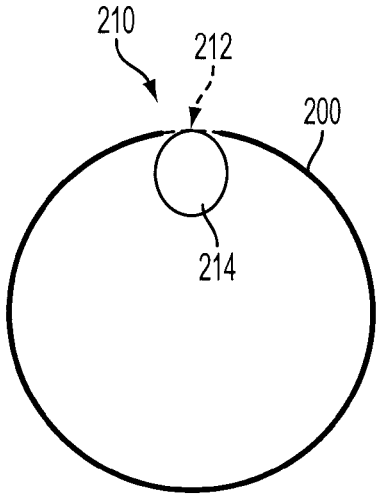
Figure 2L:
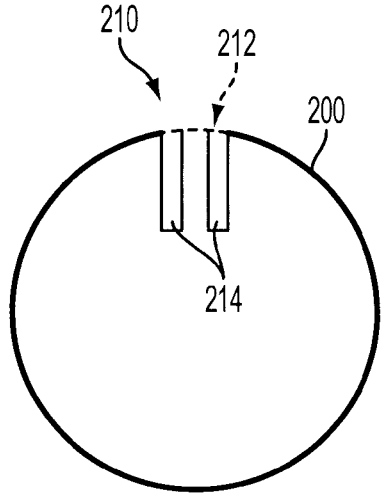

FIG. 2G, for example, shows how a tab may be of substantially similar width to the width of the opening. FIGS. 2H and 2I show how tab 214 may have a smaller or larger width than opening 212, respectively. While FIGS. 2G, 2H, and 2I show tab 214 having a substantially rectangular shape, it should be appreciated that a tab may have other shapes. For example, FIG. 2J shows a tab having a triangular shape, while FIG. 2K shows a tab having a circular shape. In yet another example, a single opening may have a plurality of corresponding tabs, for example as shown in FIG. 2L. Thus, the width of tab 214 (i.e. the width of the tab across exhaust passage) and/or shape of the tab may also be varied to achieve the desired local pressure drop, backpressure and air entrainment, and hence the desired exhaust temperature reduction.

In some cases, a plurality of openings and/or tabs may be used to provide the desired air entrainment and hence the desired temperature reduction of exhaust gases. In one approach, a plurality of openings and/or tabs may be provided axially along the length of a portion of the exhaust passage. However, this approach may provide a greater backpressure per amount of air entrained and/or temperature reduction. In another approach, a greater air entrainment and hence exhaust temperature reduction per increase of backpressure may be achieved by an air entrainment device having a plurality of openings and corresponding tabs arranged radially or in a ring configuration around the exhaust passage. In some conditions, a radial arrangement of the openings and tabs through a plane orthogonal to the axis of the exhaust passage can provide a greater flow area reduction for a given tab depth, thereby increasing the temperature reduction of the exhaust gases for the added backpressure caused by the device. While the examples provided herein describe a ring arrangement in a plane orthogonal to the axis of the exhaust passage, it should be appreciated that in other configurations, the openings and/or tabs may be offset a by some distance from the plane and from each other while still enabling at least some reduction of the backpressure penalty that would otherwise occur with the devices arranged in series.

As one non-limiting example, FIGS. 3A and 3B show an exhaust passage 310 as an exterior view and an interior view respectively. With regards to FIG. 3A, the flow of exhaust gases are indicated by vector 312. In this example, exhaust passage 310 includes an entrainment device 320 comprising four rectangular openings 330 in the surface of the exhaust passage and four rectangular tabs 340, where each tab projects inward from a leading edge of each of the openings. The openings and tabs in this example are arranged in a plane orthogonal to the flow of exhaust gases.

Continuing with FIGS. 3A and 3B, the exhaust passage may be circular with an internal diameter of approximately 4 inches, as one example. Alternatively, it should be appreciated that an exhaust passage of other suitable sizes or shapes may be used. For example, a circular exhaust passage having a diameter less than or greater than 4 inches may be used.

Exhaust passages having cross sections that are ovular, rectangular, or other shape may be used. In some cases, the level of temperature reduction and amount of air entrainment may be based on the size, shape, and number of openings and tabs in comparison to the size and shape of the exhaust passage. For example, with regards to a 4 inch circular pipe, each of the four openings may have a length of approximately 1 inch in the direction of exhaust gas flow and a width of approximately 1.5 inches.

Similarly, the tabs may be punched inward from the wall of the exhaust passage at varying angles (e.g. perpendicular to the wall of the exhaust passage or inclined thereto) and therefore may have a similar rectangular shape and size of 1 inch length and 1.5 inch width. For example, the tabs may be punched inward and inclined relative to the wall of the exhaust passage such that the tab extends a prescribed distance into the exhaust passage, thereby providing the desired reduction of flow area relative to the size of the opening. For example, a tab having a 1 inch length may be inclined away from the flow direction such that the tab penetrates approximately 0.55 inches (14 mm) into the flow area of the exhaust passage. In this manner, the flow area of an exhaust passage may be reduced by an amount depending on the level of inclination of the tab, the size of the tab, and the number of such tabs.

With reference to the configuration of FIGS. 3A and 3B, wherein the exhaust passage may include an inner diameter of 4 inches, for example, and four tabs of 1.0 inch length and 1.5 inch width, the reduction of flow area may be variable between approximately 50% when angled substantially perpendicular to the wall of the exhaust passage and 0% when angled substantially parallel to the wall of the exhaust passage. With regards to the example depth of 0.55 inches provided above for the four inclined tabs, the reduction of flow area would be approximately 25% of the flow area of the exhaust passage. Thus, a group of tabs comprising an air entrainment device for facilitating the entrainment of air into the exhaust passage may be configured to reduce the flow area of the exhaust passage between 30% and 20%, in some embodiments. In other embodiments, a group of tabs may be configured to reduce the flow area of the exhaust passage more than 30% (e.g. greater than 50%) or less than 20% (e.g. 0% in the case of substantially no tab or a highly inclined tab), depending on the level of backpressure and/or air entrainment desired.

It should be appreciated that other sizes, shapes, and numbers of openings/tabs may be used with for providing entrainment of air into the exhaust system. For example, an opening and/or tab may have a length that is greater than or less than 1 inch and/or a width that is greater than or less than 1.5 inches. As described above with reference to FIGS. 2G-2L, the openings and/or tabs may be of other suitable shapes. Further, other numbers of openings and tabs may be used such as an exhaust passage having less than or greater than four openings and corresponding tabs arranged in a radial pattern. While the examples provided herein describe the use of tabs, it should be appreciated that any suitable objected may be included in the exhaust passage to provide a desired level of air entrainment via a corresponding opening in the exhaust passage. Further still, in some embodiments, it should be appreciated that the exhaust passage may be formed or manufactured in a way that provides a substantial decrease in the flow area before an opening in the exhaust passage.

As another non-limiting example, FIGS. 4A and 4B show an example exiting pipe 410 configured as a Y-pipe for increasing the effective flow area of the exhaust system via passages 430 and 450 prior to exhausting the gases to the surrounding environment. Exiting pipe 410 can receive exhaust gases from exhaust passage 420, which may include a DPF and/or one or more air entrainment devices located upstream, as well as various other exhaust system components. Further, the first branch 430 of the Y-pipe may have at least a first group of five radially arranged openings 440 and tabs 470, and the second branch 450 may have at least a second group of five radially arranged openings 460 including tabs 480. Thus, in this example, each exhaust passage may include five sets of openings/tabs as opposed to the four sets of openings/tabs described above with reference to FIGS. 3A and 3B.

In this example, the openings and tabs may be substantially rectangular and may have a longitudinal length of approximately 1 inch and a width of approximately 1 inch. Thus, the size of the openings and tabs of FIGS. 4A and 4B may be smaller than those described above with reference to FIGS. 3A and 3B, while providing a similar amount of air entrainment since a greater number of openings and tabs may be used. However, it should be appreciated that openings and/or tabs of any suitable size or quantity may be used to achieve a desired temperature reduction of the exhaust gases.

The configurations shown in FIGS. 3 and 4 may be used together to provide air entrainment at different locations of the exhaust system. For example, exhaust passage 310 of FIG. 3 may be arranged upstream of exiting pipe 410 of FIG. 4. For example, exhaust passage 310 may be a portion of the exhaust system shown in FIG. 1A such as at pipes 140, 170, 132, and/or 134, while exiting pipe 410 may be configured at the exit of the exhaust passage at 180, for example. As another example, the air entrainment device of FIGS. 3A and 3B may be used at 136 in FIG. 1B and the air entrainment devices of FIGS. 4A and 4B may be used at 138 and 139. As shown in FIGS. 3A and 3B, each of the openings and/or corresponding tabs may be substantially similar, or in some embodiments may be of different size and/or shape. For example, each of the openings and tabs may have a similar or different shape and/or size, and the tabs may be inclined at the same or different angles. Further, other numbers of openings and/or tabs may be used. For example, an air entrainment device may include a group of 2, 3, 4, 5, 6, 7, 8, 9, 10, 11, or 12, etc. openings and/or corresponding tabs.

Further, the level of noise produced by the entrainment of air into the exhaust passage may be increased or decreased by adjusting one or more of the number of openings and/or tabs per radial group, the number of radial groups along the exhaust system, the size of the openings and/or tabs, the shape of the openings and/or tabs or other parameters described with reference to FIG. 2.

As one prophetic example, the level of noise created by the entrainment device for a given amount of air entrainment may be reduced by reducing the number of openings/tabs while also increasing the size of the openings/tabs. For example, the number of openings and tabs may be reduced from eight to four, while the total effective area of the openings and the total effective un-obstructed flow area of the exhaust passage may remain substantially the same by accordingly varying the size of the openings/tabs. In this manner, the level of noise produced by the exhaust system may be increased or decreased by adjusting one or more parameter of the air entrainment device.

Air entrainment devices having radially arranged openings and corresponding tabs may be arranged in various locations along the exhaust system to provide the desired air entrainment, exhaust temperature reduction, and/or backpressure increase or reduction. In some embodiments, as shown in FIG. 1A or 1B, a first air entrainment device including a first group of radially arranged openings (e.g. as shown in FIGS. 3A and 3B) may be located downstream of a DPF such as shown generally at 130 to provide a first entrainment of ambient air. Alternatively or additionally, in some embodiments, an air entrainment device including a radially arranged group of openings may be located upstream of the DPF or catalyst. In some embodiments, one or more air entrainment devices (e.g. as shown in FIGS. 4A and 4B) may be located at the exiting pipe of the exhaust system and may include one or more groups of radially arranged openings and/or tabs, for example, as shown in FIG. 1A with reference to openings 132 and 134 located on pipes 182 and 184, respectively. Thus, it should be appreciated that the air entrainment devices described herein may be arranged at any suitable location along the exhaust passage.

In alternative embodiments, other exiting pipes may be used to achieve an increased effective flow area. For example, FIG. 5A shows an exiting pipe that enables an expansion of the exhaust gases from exhaust passage 520 prior to being exhausted to the surrounding environment. As shown in FIG. 5A, exiting pipe 510 may have a cross-section that is circular, or it may be of rectilinear, ovular, or other shape. Further, exiting pipe 510 may include an air entrainment device including one or more openings and tabs to entrain air into the exhaust flow before being exhausted to the surrounding environment. For example, as shown in FIG. 5A, air entrainment device 530 may include a plurality of radially arranged openings and corresponding tabs. Further, one or more tabs and/or openings may be arranged along the exhaust passage after an expansion to provide additional cooling of the exhaust gases.

Further, FIG. 5B shows an exiting pipe 540 configured to increase the effective flow area of the exhaust system from exhaust pipe 560. As shown in FIG. 5B, exiting pipe 540 may have other configurations and/or shapes such as a single pipe having an oval cross-section. Further, exiting pipe 540 is shown having an air entrainment device 550 having a plurality of radially arranged openings and tabs. Further, exiting pipes having more than two branches may be used.

Figure 6A:
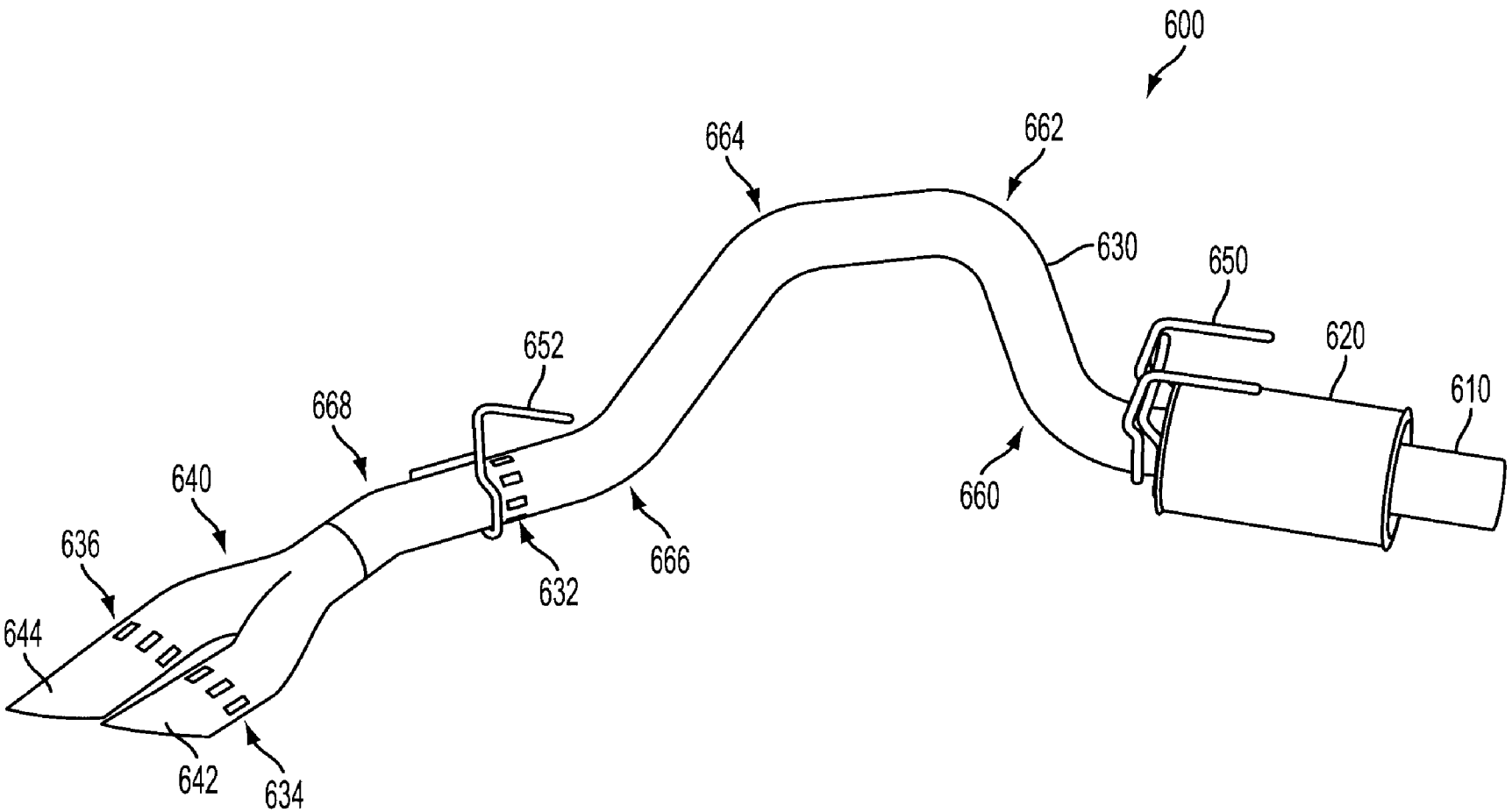
FIGS. 6A and 6B shows an example exhaust system that including a plurality of bends and air entrainment devices.

In some embodiments, an exhaust system, such as exhaust system 100 described above with reference to FIG. 1A or 1B may include one or more bends. For example, FIG. 6A shows an exhaust system 600 having a diesel particulate filter DPF 620 configured to receive exhaust gases via pipe 610 coupled upstream to an engine. Exhaust gases filtered by DPF 620 can pass through exhaust pipe 630 having a plurality of bends 660, 662, 664, 666, 668 before being exhausted to the surrounding environment via exit pipe 640. In some examples, these bends may be used to accommodate the shape of the vehicle and/or may be used to increase the effective length of between various components of the exhaust system. By varying the location of the entrainment devices relative to the bends, the amount of entrainment and/or temperature of the entrained air may be varied. For example, if a group of entrainment devices are sufficiently close and downstream of a bend, the flow may not have recovered and may be biased to the outside of the bend, potentially resulting in less effective air entrainment. Thus, the proximity of an opening and/or tab of an entrainment device to a bend in the exhaust passage is yet another parameter that may be adjusted to vary the amount of air entrainment, temperature reduction of exhaust gas, backpressure provided to the exhaust system and/or level of noise generated by the device.

Exiting pipe 640 is shown in FIG. 6A as a Y-pipe having a first branch 642 and a second branch 644, however it should be appreciated that other exiting pipes may be used for increasing the effective flow area of the exhaust system. In this example, the exiting region of the first branch 642 and the second branch 644 are shown to be tapered. This tapered configuration may be used to affect the flow characteristics at the outlet of the exiting pipe or pipes. Further, as shown in FIG. 6A, the exhaust system may include one or more hangers such as 650 and 652 for supporting and/or coupling the exhaust system to the underside of a vehicle, for example, as shown in FIG. 6B.

Exhaust system 600 may further include various air entrainment devices 632, 634, and 636, each having a plurality of radially arranged openings and corresponding tabs disposed therein. As shown in FIG. 6A, a first air entrainment device 632 may be arranged in the exhaust system downstream of DPF 620 and one or more air entrainment devices 634 and 636 may be arranged in the exiting pipe having a greater effective flow area than the upstream exhaust passages. For example, air entrainment device 632 may include the air entrainment configuration shown in FIGS. 3A and 3B, while air entrainment devices 634 and 636 may include those shown in FIGS. 4A and 4B.

Further, in some conditions, objects external the exhaust passage and substantially near an air entrainment device may affect the amount of air and/or temperature of the air entrained into the exhaust system. For example, hangers used to secure the exhaust system to the vehicle may vary the entrainment provided by the device. Thus, by varying the location of an air entrainment device relative to various components of the exhaust system, a different air entrainment, exhaust temperature reduction and/or backpressure may be achieved, at least under some conditions.

Figure 6B:
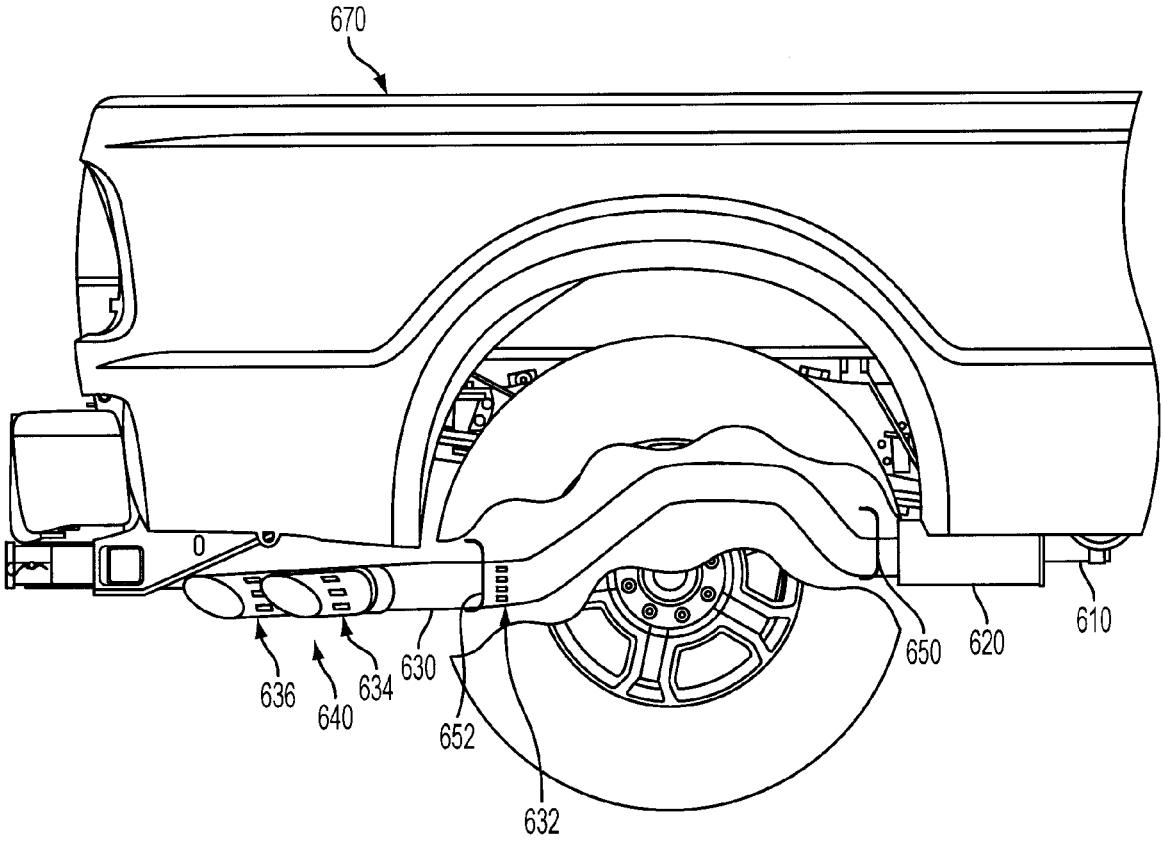

FIG. 6B shows the exhaust system of FIG. 6A coupled to the underside of a pick-up truck vehicle 670. In particular, FIG. 6B shows a rear portion of vehicle 670, wherein the exhaust system is configured so that exhaust gases produced by the engine exit the exhaust system in the vicinity of the rear of the vehicle. While not shown in FIGS. 6A and 6B, the exhaust system may include a resonator as described above with reference to FIG. 1B for reducing, varying, or canceling the noise produced by one or more of the air entrainment devices.

Figure 7A:
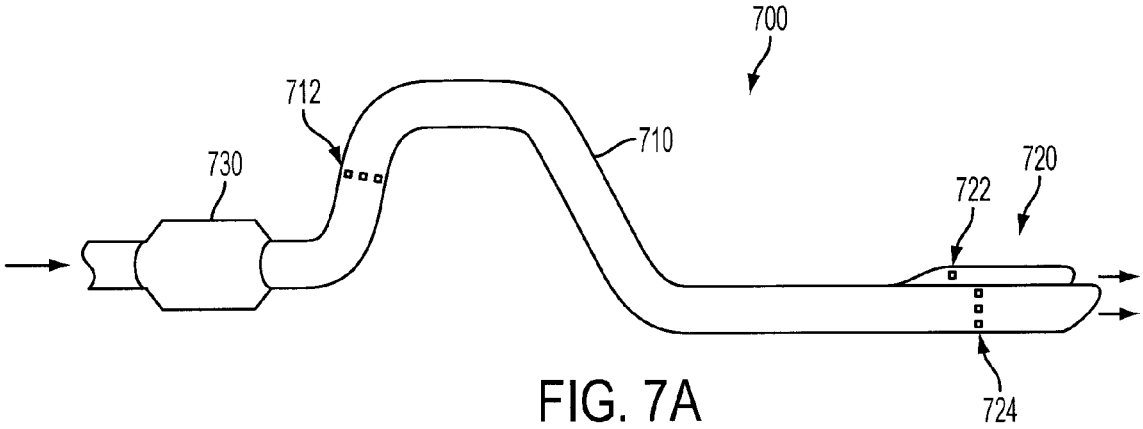
FIGS. 7A, 7B, and 7C show example exhaust systems having different air entrainment device locations.
Figure 7B:
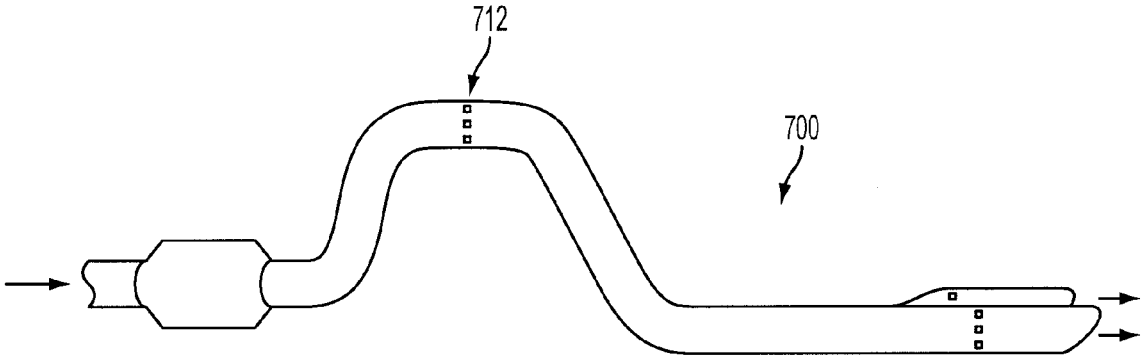
Figure 7C:
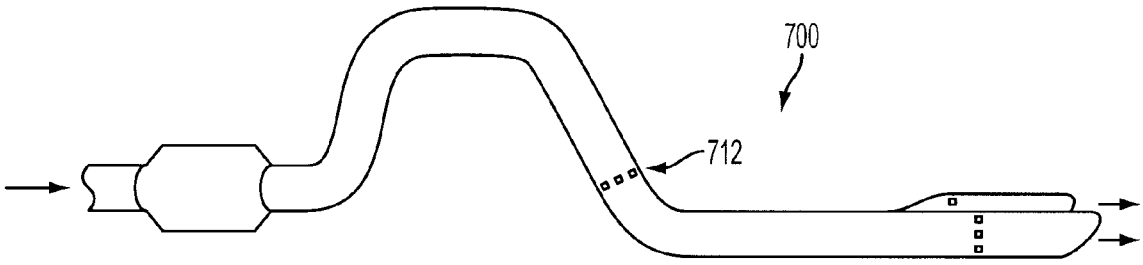

FIGS. 7A, 7B, and 7C show side views of example exhaust systems having a plurality of bends and air entrainment devices. For example, FIG. 7A shows an exhaust system 700 having an exhaust passage 710 located downstream of a DPF 730 and including a plurality of bends. Exhaust passage 710 is shown including a first air entrainment device 712 located along a region of the exhaust passage providing an upward exhaust flow direction. Further, exiting pipe 720 configured at a Y-pipe is shown coupled to exhaust passage 710 and including air entrainment devices 722 and 724 located in each of the branches.

FIGS. 7B and 7C show how air entrainment devices may be located in various other regions of exhaust system 700. For example, as shown in FIG. 7B, air entrainment device 712 may be located along a region of the exhaust passage providing a horizontal exhaust flow direction between two bends. In another example, as shown in FIG. 7C, air entrainment device 712 may be located along a region of the exhaust passage providing a downward exhaust flow direction. By varying the location of the air entrainment device, such as device 712, the amount of air entrained, the exhaust temperature reduction, and the backpressure may be varied.

Figure 8A:
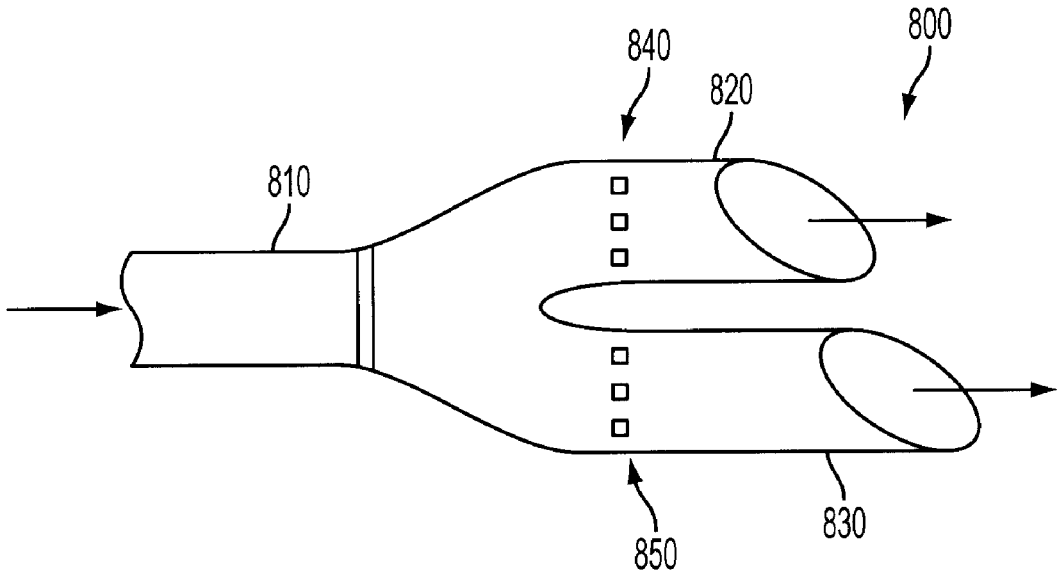
FIGS. 8A and 8B show example exiting pipe configurations.
Figure 8B:
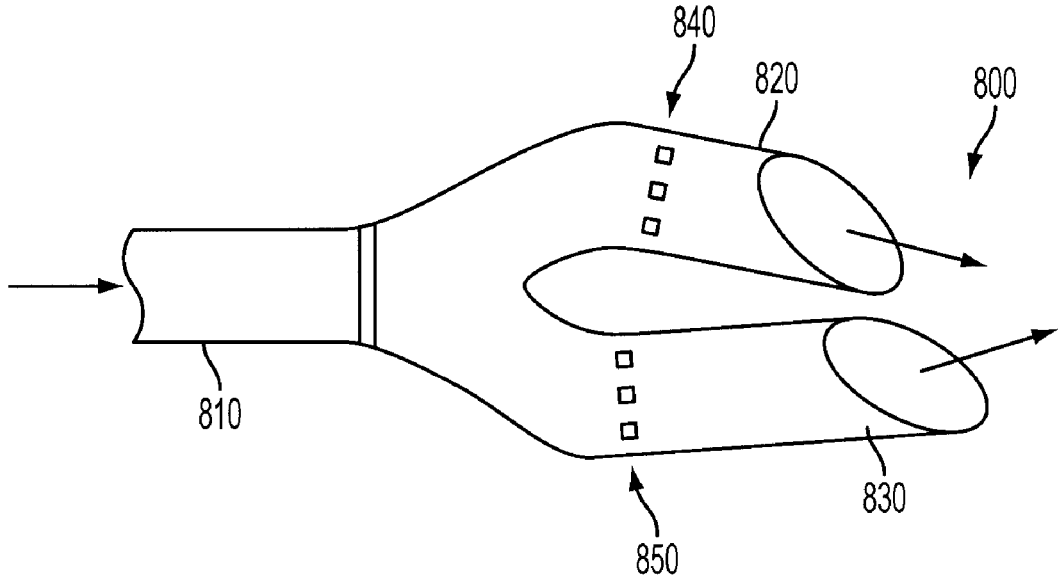

FIGS. 8A and 8B show examples of an exiting pipe having a Y-pipe configuration. Exiting pipe 800 is shown coupled downstream of an exhaust passage 810. Exiting pipe 800 provides an effective increase of the flow area from exhaust passage 810 via branches 820 and 830. As shown in FIGS. 8A and 8B, branches 820 and 830 may have an angled opening and/or may be offset from each other, such that one of the branches is longer than the other. As described above, these branches may include air entrainment devices 840 and 850 each having a plurality of radially arranged openings and corresponding tabs. The orientation of each of the branches can further affect how the exhaust gases mix with the surrounding environment when exiting the exhaust system. For example, FIG. 8A shows branches 820 and 830 having a substantially parallel configuration, while FIG. 8B shows branches 820 and 830 having their respective exhaust openings angled toward each other. For example, one or more of branches 820 and 830 may angled toward the other branch at an angle of 5, 10, 15, or more degrees. In this manner, exhaust gases exiting each of the branches may mix, thereby causing a different amount of mixing with the surrounding ambient air. In some embodiments, branches 820 and 830 may be angled away from each other.

In some embodiments, for example, as shown in FIGS. 6, 7, and 8, the openings or cuts at the end of the exiting pipes may be arranged at an angle relative to a plane orthogonal to the axis of the pipe. Further, the openings of the exiting pipes can be parallel to each other (i.e. arranged along the same plane or parallel planes) while being configured at an angle relative to an orthogonal cross-section of the pipe. In some embodiments, the openings of the exiting pipes may be aligned with a body panel or other portion of the vehicle. For example, FIG. 6B shows how the openings of the two exiting pipes can be arranged so that the openings are parallel to or in the same plane as a rear body portion of the vehicle. The angle or skew of the openings may depend on the angle of the exhaust passage relative to the side or rear portion of the vehicle. For example, an exhaust passage having one or more exiting pipes projecting from the side or rear of the vehicle at a right angle may have a substantially orthogonal opening (e.g. as shown in FIG. 4A), while an exhaust passage approaching the side or rear of the vehicle at a different angle may have skewed exhaust passage openings along a substantially parallel plane as the side or rear of the vehicle (e.g. as shown in FIG. 6B). In some conditions, these angled openings can provide different mixing, cooling, and/or dissipation of exhaust gases with the surrounding environment and/or may be added for aesthetic value of the vehicle While some of the examples figures described herein show exhaust systems having a single air entrainment device in the exhaust passage having smaller effective flow area and two air entrainment devices in a exiting pipe having a Y configuration of a larger effective flow area, it should be appreciated that other exhaust system configurations may be used. For example, in addition to the variations already noted, an exhaust system may include one or more air entrainment devices in various locations along a portion of the exhaust system having a smaller effective flow area than the exiting pipe and/or may include one or more air entrainment devices in various locations along the exiting pipe providing a larger or smaller effective flow area. Further, it should be appreciated that the air entrainment devices described herein may include one or more openings and/or one or more corresponding tabs.

It will be appreciated that the configurations disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

I claim:

1. An exhaust system for an engine, comprising:

a first exhaust passage providing a first flow area;

a second exhaust passage communicatively coupled to the first exhaust passage, the second exhaust passage providing a second flow area greater than the first flow area, wherein the second exhaust passage is arranged downstream of the first exhaust passage;

wherein a first wall surface of the first exhaust passage defines at least a first opening for transferring air external the first exhaust passage to within the first exhaust passage and a second wall surface of the second exhaust passage defines at least a second opening for transferring air external the second exhaust passage to within the second exhaust passage;

a first protrusion disposed within the first exhaust passage upstream of the first opening;

a second protrusion disposed within the second exhaust passage upstream of the second opening; and wherein the second exhaust passage includes a plurality of branches, wherein the second flow area is a combined flow area of the plurality of branches and is greater than the first flow area.

2. The exhaust system of claim 1 further comprising a particulate filter communicatively coupled to the first exhaust passage.

3. The exhaust system of claim 1 further comprising a particulate filter coupled upstream of the first protrusion.

4. The exhaust system of claim 1, further comprising an expansion region between the first and the second exhaust passages.

5. The exhaust system of claim 1, wherein the second exhaust passage forms a Y-pipe having a first branch and a second branch.

6. The exhaust system of claim 4, wherein the expansion region directs a flow of exhaust gases from the first exhaust passage to the second exhaust passage by increasing an effective flow area between the first exhaust passage and the second exhaust passage.

7. The exhaust system of claim 1, wherein the first protrusion is arranged within the first exhaust passage to increase a velocity of exhaust gases flowing within the exhaust passage and to reduce pressure of exhaust gases flowing in a vicinity of the first opening, thereby transferring air external the first exhaust passage into the first exhaust passage via the first opening.

8. The exhaust system of claim 1, wherein the first protrusion is arranged relative to the first opening so that air external the first exhaust passage is entrained into the first exhaust passage when exhaust gases are transported through the first exhaust passage.

9. The exhaust system of claim 1, wherein the first protrusion is located substantially proximate the first opening and the second protrusion is located substantially proximate the second opening, the first protrusion forming a first tab and the second protrusion forming a second tab.

10. The exhaust system of claim 1, wherein the first protrusion is coupled to an inner wall of the first exhaust passage and the second protrusion is coupled to an inner wall of the second exhaust passage.

11. The exhaust system of claim 1, wherein the first wall surface of the first exhaust passage defines a plurality of openings for transferring air external the first exhaust passage to within the first exhaust passage, and wherein the plurality of openings are arranged radially about the exhaust passage through a plane substantially normal to an axis of the exhaust passage.

12. The exhaust system of claim 11, further comprising a plurality of protrusions disposed within the first exhaust passage and wherein at least one protrusion is disposed upstream and proximate each of the plurality of openings.

13. An exhaust system for a vehicle having a diesel engine, comprising:

an exhaust passage having a first end communicatively coupled to the engine and at least a first and a second branch having outlets communicating with ambient air;

a diesel particulate filter disposed along the exhaust passage upstream of the first and the second branches for filtering exhaust gases produced by the engine;

a plurality of air entrainment devices for entraining ambient air external the exhaust passage into the exhaust passage, wherein each of the plurality of air entrainment devices includes at least one opening defined by a wall surface of the exhaust passage and at least one tab protruding into a flow area of the exhaust passage upstream and proximate the at least one opening; and wherein a first group of the plurality of air entrainment devices are arranged radially about the exhaust passage downstream of the diesel particulate filter and upstream of the first and the second branches, a second group of the plurality of air entrainment devices are arranged radially about the first branch of the exhaust passage, and a third group of the plurality of air entrainment devices are arranged radially about the second branch of the exhaust passage.

14. The exhaust system of claim 13, wherein the first and the second branches provide a combined flow area that is greater than the flow area of the exhaust passage upstream of the first and the second branches.

15. The exhaust system of claim 13, wherein the first group, the second group and the third group each include at least two air entrainment devices.

16. The exhaust system of claim 13, wherein the first and second branches have at least one non-parallel section so that exhaust gases exiting the first and second branches are directed at least partially toward one another.

17. The exhaust system of claim 13, wherein an end of the first branch defining a first opening is angled relative to a plane orthogonal to an axis of the first branch, and wherein an end of the second branch defining a second opening is angled relative to a plane orthogonal to an axis of the second branch, and wherein the end of the first branch and the end of the second branch are at least one of parallel to each other and coplanar.

18. A method of cooling exhaust gas in an exhaust passage of an internal combustion engine of a vehicle, comprising:

entraining air in exhaust gas produced by the engine by flowing said exhaust gas past a first protrusion into gas flow followed by a first opening, said first opening allowing said entrained air to enter the exhaust gas;

expanding said exhaust gas and said entrained air;

further entraining additional air in said expanded exhaust gas and air by flowing said expanded exhaust gas and air past a second protrusion into gas flow followed by a second opening, said second opening allowing said further entrained air to enter the expanded exhaust gas and air; and wherein said expansion occurs at least partially via a Y-pipe forming at least part of the exhaust passage of the engine and wherein entraining air in exhaust gas includes flowing the exhaust gas past a first set of a plurality of protrusions followed by a first set of a plurality of openings defined by a wall surface of the exhaust passage, and said further entraining air in expanded exhaust gas and air includes flowing said expanded exhaust gas and air past a second set of the plurality of protrusions follow by a second set of the plurality of openings defined by the wall surface of the exhaust passage.

19. The method of claim 18, further comprising, regenerating a diesel particulate filter located upstream of the first opening, wherein exhaust gases are discharged from the diesel particulate filter during the regeneration.

20. The method of claim 19 wherein said expansion occurs at least partially via an increase in flow area of the exhaust passage.

21. The method of claim 18 wherein said first set of protrusions are substantially proximate said first set of openings and said second set of protrusions are substantially proximate said second set of openings, and at least some of said plurality of protrusions are welded to an inner wall surface of the exhaust passage.

* * * * *